US009062676B2

(12) United States Patent
Garner

(10) Patent No.: US 9,062,676 B2
(45) Date of Patent: Jun. 23, 2015

(54) POSITIVE DISPLACEMENT PUMP WITH IMPROVED SEALING ARRANGEMENT AND RELATED METHOD OF MAKING

(71) Applicant: Ampco Pumps Company, Glendale, WI (US)

(72) Inventor: Bob Garner, Sturtevant, WI (US)

(73) Assignee: Ampco Pumps Company, Glendale, WI (US)

( * ) Notice: Subject to any disclaimer, the term of this patent is extended or adjusted under 35 U.S.C. 154(b) by 189 days.

(21) Appl. No.: 14/012,536

(22) Filed: Aug. 28, 2013

(65) Prior Publication Data

US 2015/0064041 A1 Mar. 5, 2015

(51) Int. Cl.

| | |
|---|---|
| ***F04C 15/00*** | (2006.01) |
| ***F04C 18/08*** | (2006.01) |
| ***F04C 2/12*** | (2006.01) |

(52) U.S. Cl.

CPC ..... *F04C 15/0038* (2013.01); *F04C 2/12* (2013.01); *F04C 15/0061* (2013.01); *F04C 2230/70* (2013.01)

(58) Field of Classification Search

CPC .. F04C 18/08; F04C 15/0038; F04C 2230/70; F04C 2/12

See application file for complete search history.

(56) References Cited

U.S. PATENT DOCUMENTS

| | | | | |
|---|---|---|---|---|
| 7,905,717 | B2 * | 3/2011 | Whittome et al. | 418/206.6 |
| 2014/0065002 | A1 * | 3/2014 | Garner et al. | 418/120 |

OTHER PUBLICATIONS

Waukesha Cherry-Burrell, SPX Universal 1 Series Rotary Positive Displacement Pumps Brochure, Issued Jan. 2012, pp. 1-12.

Waukesha Cherry-Burrell, SPX Universal 1 Series Rotary Positive Displacement Pumps Instruction Manual, Issued Apr. 2010, pp. 1-104.

Wright Flow Technologies, Installation, Operation and Maintenance Manual for the Revolution Range of Pumps, Issue C—May 21, 2012, pp. 1-74.

* cited by examiner

*Primary Examiner* — Mary A Davis

(74) *Attorney, Agent, or Firm* — Quarles & Brady LLP

(57) ABSTRACT

A rotary positive displacement pump comprising a pair of forwardly-positioned sealing arrangements and a pair of rearwardly-positioned selective sealing arrangements. The forwardly-positioned sealing arrangements each form a dynamic seal between a central portion of the one of the rotors and a corresponding hub proximate the forward ends of the shafts on which the rotors are received. The rearwardly-positioned selective sealing arrangements are located between the gear case and the pump body proximate the rearward ends of the shafts. When the rotors are secured to the shafts, the rearwardly-positioned selective sealing arrangements do not establish seals between the gear case and the pump body. However, when the rotors are removed from the shafts, the rearwardly-positioned selective sealing arrangements establish seals between the gear case and the pump body.

19 Claims, 7 Drawing Sheets

POSITIVE DISPLACEMENT PUMP WITH IMPROVED SEALING ARRANGEMENT AND RELATED METHOD OF MAKING

CROSS-REFERENCE TO RELATED APPLICATIONS

Not applicable.

BACKGROUND

This disclosure relates to rotary positive displacement pumps. In particular, this disclosure relates to improvements for rotary positive displacement pumps such as circumferential piston pumps.

Pumps, such as rotary positive displacement pumps, can be used to transport fluids through a system. In a rotary positive displacement pump, two or more counter-rotating lobes are disposed in a cavity typically defined by a pump body and an associated cover. This cavity has an inlet on one side of the rotary lobes through which the fluid material is initially received and an outlet on the other side of the rotary lobes through which the fluid material is forced out of the pump. A gear case, which typically supports the pump body, has shafts that attach to the rotors. When the gear case drives the rotation of these shafts, the attached rotors rotate, thereby causing the pumping action.

Although positive displacement pumps of the type described above have existed for some period of time, the continued maintenance and service of these pumps has presented unique challenges. With thousands of pumps of this kind in service throughout the world, there is a continued need for improvements.

SUMMARY OF THE INVENTION

As will be described in further detail below, the industry-standard rotary positive displacement pump structure, such as the Ampco Pumps® ZP1 Series Positive Displacement Pumps or the Waukesha Cherry-Burrell® Universal I Series PD Pumps, require that the entire pump body be detached from the gear case in order to service the seals that are disposed between the gear case and the pump body. For decades this has meant that, in order to service or clean portions of the pump, the pump would need to be subject to long periods of downtime in which the pump body would need to be removed from the gear case in order to access the seals.

An improved pump assembly is disclosed that offers improved serviceability. This is achieved by moving the primary sealing arrangement that seals the internal cavity of the pump when the rotors are in place forward, such that this sealing arrangement can be accessed and removed without disassembling the pump body from the gear case. Additionally, a secondary sealing arrangement is introduced that selectively seals the internal cavity of the pump when the rotors and the primary sealing arrangement are removed for service. This secondary sealing arrangement permits the surrounding equipment to be cleaned when the primary sealing arrangement is removed; however, during normal operation of the pump, this secondary sealing arrangement is not typically exposed to the fluid being pumped (as this is the function of the primary sealing arrangement) and does not form a seal.

Notably, while newly-built rotary positive displacement pumps can be constructed to have these advantages, it is also possible to modify or re-build existing industry-standard rotary positive displacement pumps to include these advantages. This means that thousands of pumps which are currently in service do not need to be replaced, but merely rebuilt, in order to achieve many of the benefits of the new pump structure.

According to one aspect of the invention, a rotary positive displacement pump for pumping a fluid is disclosed. The rotary positive displacement pump has a gear case including a pair of shafts extending from the gear case at a forward end. On a forward end of the gear case, a pump body is supported by the gear case. The pump body has a cover attached to it so as to define a cavity between the pump body and the cover in which the cavity has an inlet and an outlet. The pump body has a pair of hubs that extend into this cavity in which each of the pair of hubs has an axially-extending opening. Through each one of the axially-extending openings, a corresponding one of the pair of shafts from the gear case is received. A pair of rotors are received on the pair of shafts. Each of the pair of rotors has a central portion received on one of the pair of shafts inside the axially-extending opening of the hub and wings are attached to the central portion of the rotor such that the wings of the rotor are disposed radially outward of the hub. The rotors on the pair of shafts are rotatable in opposite directions to pump a fluid through the pump body from the inlet through the cavity to the outlet. Notably, the pump includes a pair of forwardly-positioned sealing arrangements and a pair of rearwardly-positioned selective sealing arrangements. The pair of forwardly-positioned sealing arrangements each form a dynamic seal between the central portion of one of the pair of rotors and a corresponding one of the pair of hubs proximate a forward end of the pair of shafts. The pair of rearwardly-positioned selective sealing arrangements are positioned between the gear case and the pump body proximate a rearward end (or base) of the pair of shafts. When the pair of rotors are secured to the pair of shafts, then the pair of rearwardly-positioned selective sealing arrangements do not establish seals between the gear case and the pump body. However, when the pair of rotors are removed from the pair of shafts (such as may be the case during cleaning), then the pair of rearwardly-positioned selective sealing arrangements establish seals between the gear case and the pump body.

As noted above, the pair of rotors and the pair of forwardly-positioned sealing arrangements are removable from the rotary positive displacement pump without removing the pump body from the gear case (which is time and labor intensive). However, even when the rotors are removed, seals are selectively formed by the rearwardly-positioned selective sealing arrangements that permit the surrounding equipment to be cleaned by passing liquid at high velocity through the rotor-less cavity without fluid leakage at the rear side of pump body where the pump body is attached to the gear case.

Each of the forwardly-positioned sealing arrangements may include a forward sleeve, a static o-ring seal, and a dynamic o-ring seal. The forward sleeve may be received around the central portion of the rotor and may be positioned between the central portion of the rotor and one of the pair of hubs of the pump body. The static o-ring seal can establish a static seal between the forward sleeve and the rotor while the dynamic o-ring seal can establish the dynamic seal between the forward sleeve and the hub.

The forward sleeve and the rotor may be rotationally coupled to one another. This could be done, for example, by having a projection on the forward sleeve that extends radially inward and having a recess on a radially outward facing surface of the central portion of the rotor. The recess could include a narrow section extending from an axial end of the central portion of the rotor to a wide section of the recess at the other end of the narrow section in which the wide section has a larger angular extent than the narrow section. The projection can be received in the recess when the forward sleeve is received around the central portion of the rotor in order to rotationally couple the forward sleeve to the rotor.

One or more of the pump body, forward sleeves, and rotors may be constructed (or modified if an existing pump is retrofit) to accommodate the seals and associated o-rings. For example, an annular channel may be formed on a radially inwardly facing surface of the hub and the dynamic o-ring seal may be received, at least in part, in the annular channel such that the dynamic seal is established between the radially inward facing surface of the hub and a radially outward facing surface of the forward sleeve. Likewise, the static o-ring seal may be received between a radially outward facing surface of the forward sleeve and a radially inward facing surface of the rotor and may, at least in part, be received in an annular channel in the radially outward facing surface of the forward sleeve.

The rotor may include a disc-shaped portion connecting the wings of the rotor to the central portion of the rotor at a forward end of the rotor. In a rearwardly facing axial surface of the disc-shaped portion between the central portion and the wings, a groove may be formed. A forward end of the forward sleeve may be received into this groove and the static o-ring seal may be disposed between the forward sleeve and a radial wall of the groove.

The pair of rearwardly-positioned selective sealing arrangements may each include a slidable sleeve, a biasing mechanism (such as, for example, a spring), and at least two o-rings.

The slidable sleeve can be movable between a non-sealing position (in which at least one of the o-rings does not establish a seal) and a sealing position (in which at least one of the o-rings establishes a seal between the slidable sleeve and the pump body and in which at least one of the o-rings establishes a seal between the slidable sleeve and the shaft or other part of the gear case). The slidable sleeve may move linearly between the sealing position and the non-sealing position along a direction of movement and the slidable sleeve may include a sealing surface not parallel with the direction of movement (for example, an angled, canted, or oblique surface relative to the direction of movement). When the slidable sleeve is moved to the sealing position, the sealing surface establishes a portion the seal with at least one of the o-rings.

The biasing mechanism can bias the slidable sleeve toward the sealing position such that, when the rotor is secured to the shaft, an axial end of the rotor engages an axial end of the slidable sleeve to counteract and overcome the biasing force and to move the slidable sleeve to the non-sealing position. When the rotor is absent from the shaft, there is no counteracting force and the biasing force maintains the slidable sleeve in the sealing position.

In some forms, the slidable sleeve can include two parts separated by the biasing mechanism (as in the embodiment described below). However, it is also contemplated that the slidable sleeve could be one part and that the biasing mechanism may be positioned between the slidable sleeve and a base of the shaft or other part of the gear case.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENT

Figure 1:
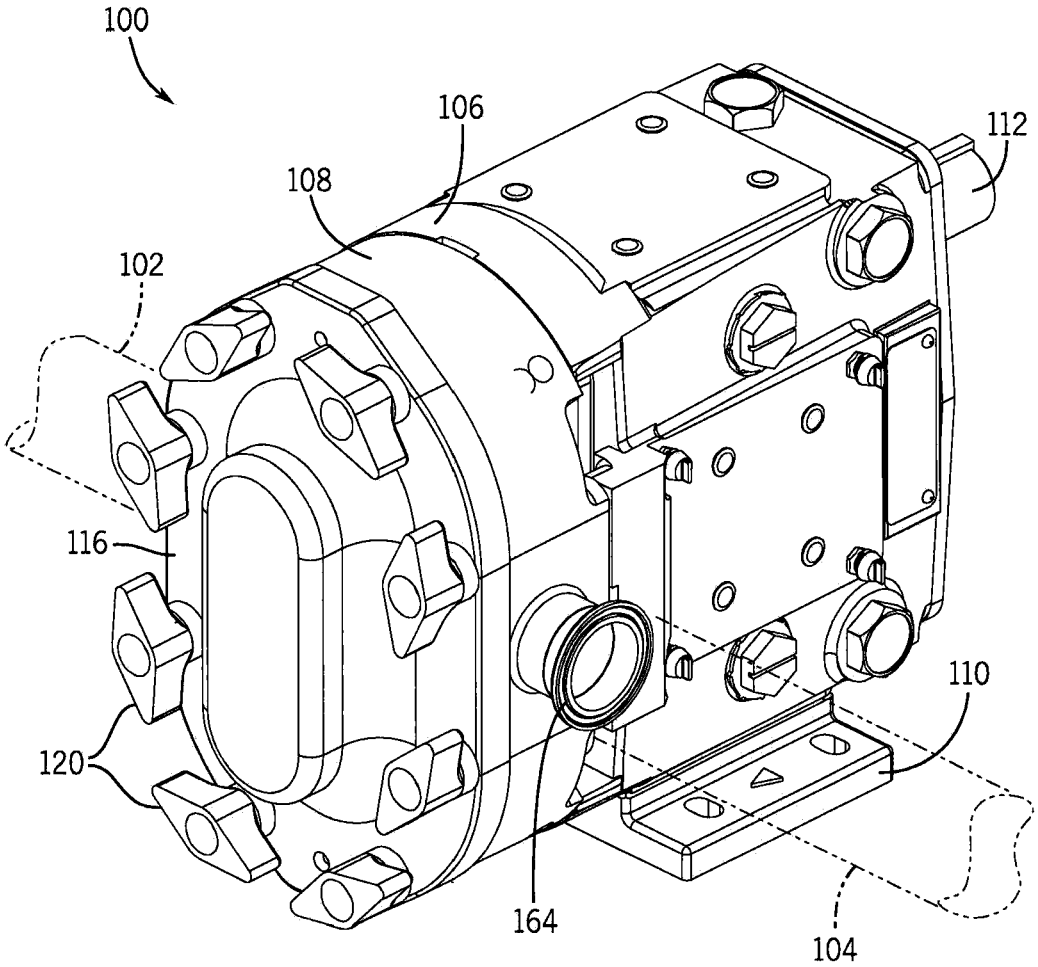
FIG. 1 is a perspective view of the exterior of a universal pump.

A rotary positive displacement pump according to one aspect of the invention will now be described in detail. Because the improved and modified version of the pump shares a number of common features with a prior art version of the pump, various figures are provided that illustrate the prior art pump 100 and the improved pump 200 for comparative purposes. A number of components or parts of the prior art pump 100 and the new pump 200 are similar; however, there are also differences between the prior art pump 100 and the new pump 200. Accordingly, the following detailed description is to be read with reference to the figures, in which like elements in different figures have like reference numerals. For example, component 108 (the pump body) in the prior art pump 100 will generally correspond in structure and function to the component 208 in the new pump 200. In the instances where differences exist between the prior art pump 100 and the new pump 200, those differences will be described in the text of this specification and/or illustrated in the figures.

The exterior of the pump, which is identical between the prior art pump 100 and improved pump 200, is shown in FIG. 1. For the sake of simplicity and clarity, the description of the exterior will only be made with reference to the prior art pump 100, but the same description is equally applicable to the improved pump 200.

In FIG. 1, a rotary positive displacement pump 100 is illustrated. The pump 100 illustrated in FIG. 1 is an Ampco Pumps® ZP1 Series circumferential piston pump, which is a kind of positive displacement pump. This particular style of pump is typically utilized in production of toothpaste, cosmetics, chocolate, candies, pet food, and other viscous materials, to transport fluid from an inlet line 102 connected through the pump 100 to an outlet line 104. Inlet and outlet are relative terms, of course, based on the direction in which the pump 100 is being run, and the inlet and outlet could be reversed.

In general construction, the pump 100 includes a gear case 106 with a forward end that supports a pump body 108 on a rearward end of the pump body 108. The gear case 106 and the pump body 108 may be connected to one another in a number of ways including using bolts or other fasteners. As will be described in greater detail below, portions of the gear case 106, such as output shafts, extend into the pump body 108 through the rear side of the pump body 108.

A mounting base 110 is also attached to the gear case 106 for attaching the pump 100 to a mounting surface. Although an upright orientation of gear case 106 and pump 100 is shown in the figures, it will be appreciated that the gear case 106 is adapted for connection to a variety of mounting arrangements including bottom, top, and side mounting arrangements.

Figure 2:
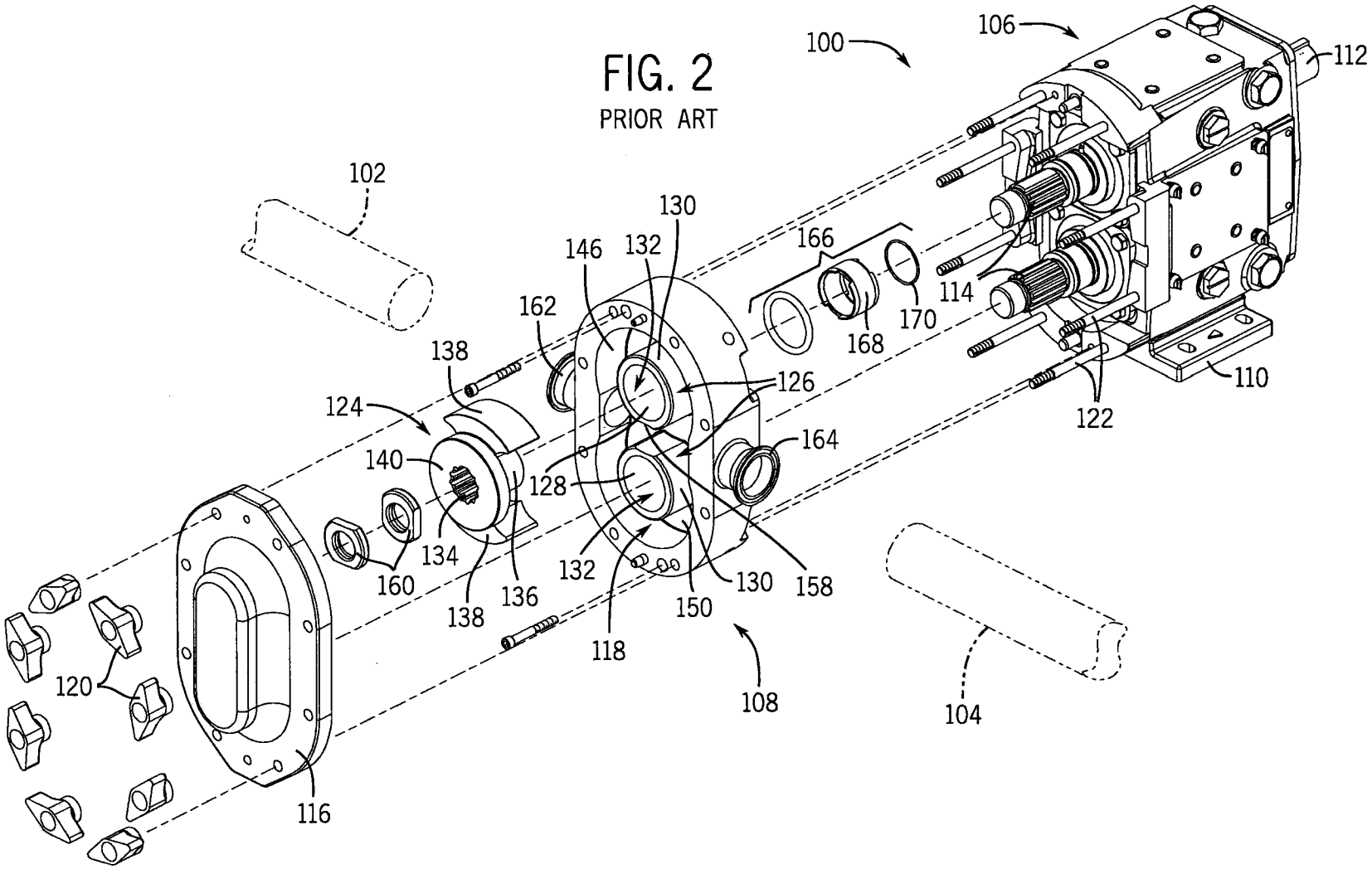
FIG. 2 PRIOR ART
FIG. 2 is an exploded perspective view of a prior art pump in which the various components of the pump, including the pump body, are illustrated disassembled from the gear case. For sake of clarity, only one of the two rotors and its associated components are exploded from the shafts.

Now with additional reference to FIG. 2 and looking more closely at the gear case 106, the gear case 106 is adapted to translate a single input rotary torque into a pair of counter-rotational output rotary torques. In the particular form illustrated, the gear case 106 is configured or adapted to receive an input rotary torque at a keyed input shaft 112 at the rear end of the gear case 106. This keyed input shaft 112 may be coupled to a motor (not shown) using a coupling (not shown) such that the input shaft 112 receives the input torque. This input torque is then translated and divided within the gear case 106 into a pair of counter-rotational torques that are provided to a pair of output shafts 114 on the front end of the gear case 106. In the form illustrated, the pair of output shafts 114 of the gear case 106 are parallel with one another and also with the input shaft 112. Because the translation and division of such torques and rotary motion is known within the gear case art, a greater description of the interior of the gear case 106 is unnecessary. Moreover, it will be appreciated that other styles of gear cases might be used with the improvements described herein.

Figure 3:
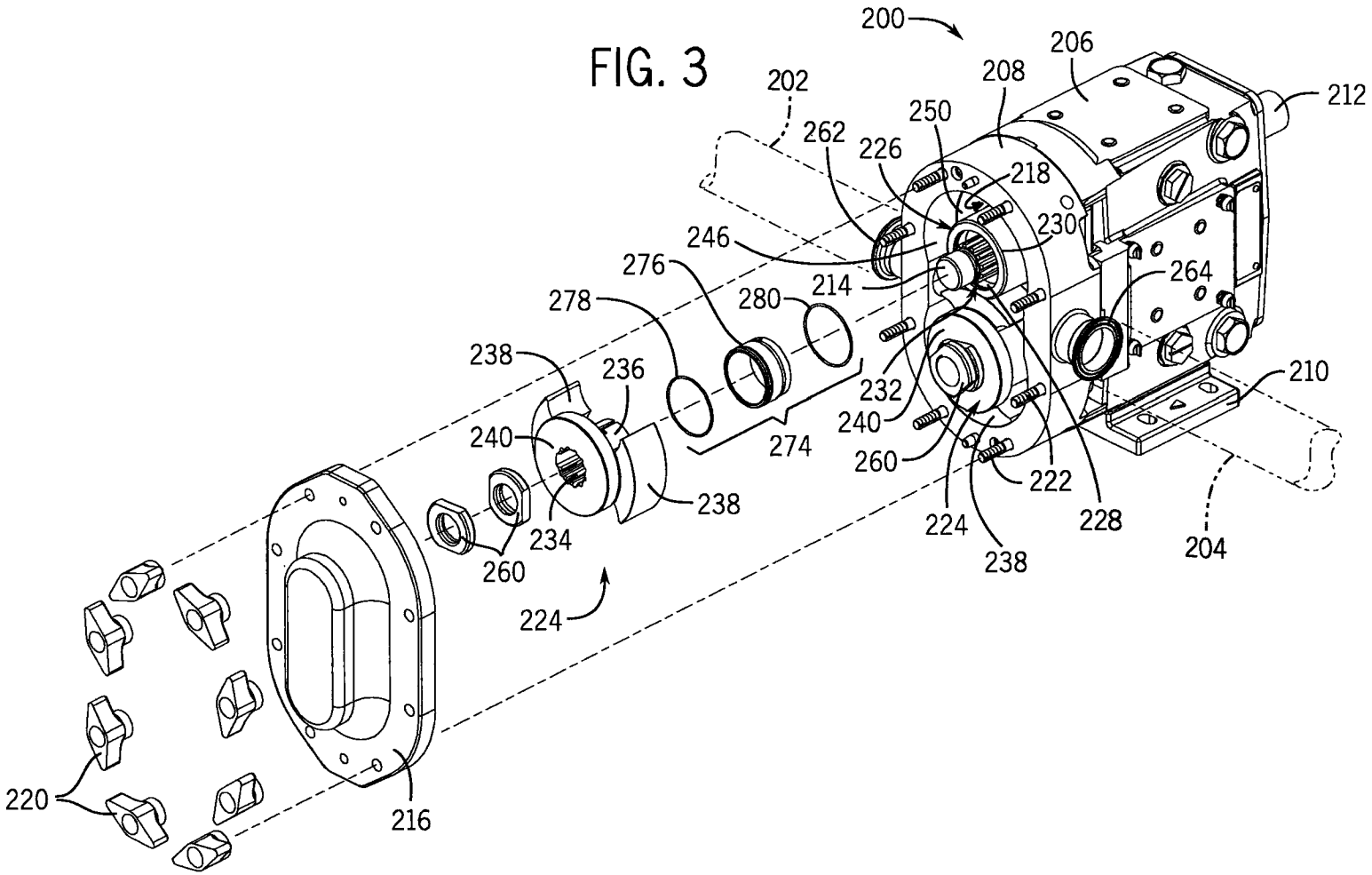
FIG. 3 is an exploded perspective view of an improved pump in which various components of the pump are illustrated disassembled from the gear case for access to one of the forwardly-positioned sealing arrangements, and in which the pump body remains affixed to the gear case.

Now returning to the pump body 108, 208 and with specific reference to FIGS. 2 and 3, a cover 116, 216 has been removed from a front side of the pump body 108, 208 to reveal an internal cavity 118, 218 of the pump body 108, 208. This cover 116, 216 may be removed once a set of fastening handles 120, 220 are unscrewed from threaded posts 122, 222 that are attached to and extend forwardly from the gear case 106, 206 and through openings in the pump body 108, 208. With the cover 116, 216 removed, and as further depicted in FIGS. 4 through 7, it is clear that the internal cavity 118, 218 of the pump body 108, 208 houses a pair of intermeshed rotors 124, 224 which are attached to the output shafts 114, 214.

For the sake of clarity in the illustration and to reduce the number of components illustrated, FIG. 2 only shows a single rotor 124 exploded from the upper one of the output shafts 114. However, a second rotor would be received on the lower one of the output shafts 114 and would have wings that are 90 degrees offset from the orientation of the wings on the upper one of the rotors 124 such that the wings of the rotors 124 intermesh. FIG. 3, which depicts the improved pump 200, illustrates both rotors 224, with the upper one of the rotors 224 being shown exploded from an upper one of the output shafts 214 and the lower one of the rotors 224 being still attached to a lower one of the output shafts 214 inside the internal cavity 218.

As can be best seen in FIG. 2, which illustrates the prior art pump 100, a pair of hubs 126 that are generally cylindrically tubular shaped protrude from the rear or base wall of the pump body 108. Although only an upper one of the hubs 226 is illustrated in FIG. 3, a bottom one of the hubs 226 that is generally similar to the top one of the hubs 226 can be found under the lower one of the rotors 224. Each of the pair of hubs 126, 226 have a radially inward facing surface 128, 228 and a radially outward facing surface 130, 230 (the radially outward facing surface 130, 230 extends around only a portion of the total circumference of the hub 126, 226, as there is a cutout region for accommodating the passage of the wings of the rotors). Each of the pair of hubs 126, 226 each have an axially-extending opening 132, 232 in which one of the pair of output shafts 114, 214 of the gear case 106, 206 is received onto which one of the rotors 124, 224 are secured.

Each of the rotors 124, 224 are received onto a corresponding output shaft 114, 224 by telescopically inserting a splined opening 134, 234 of a central portion 136, 236 of the rotor 124, 224 onto the output shaft 114, 214 such that the central portion 136, 236 of the rotor 124, 224 is disposed between the hub 126, 226 and the shaft 114, 214. In the form illustrated, the rotors 124, 224 and the output shafts 114, 214 are in splined engagement with one another, with the profile of the splined opening 134, 234 on the rotor 124, 224 and the profile of the output shaft 114, 214 having a similar cross sectional profile, so that the rotor 124, 224 is driven by the rotation of the shaft 114, 214 via the splined engagement. Of course, other types of engagement may also be used such as, for example (but not limited to), keyed engagement.

Figure 9:
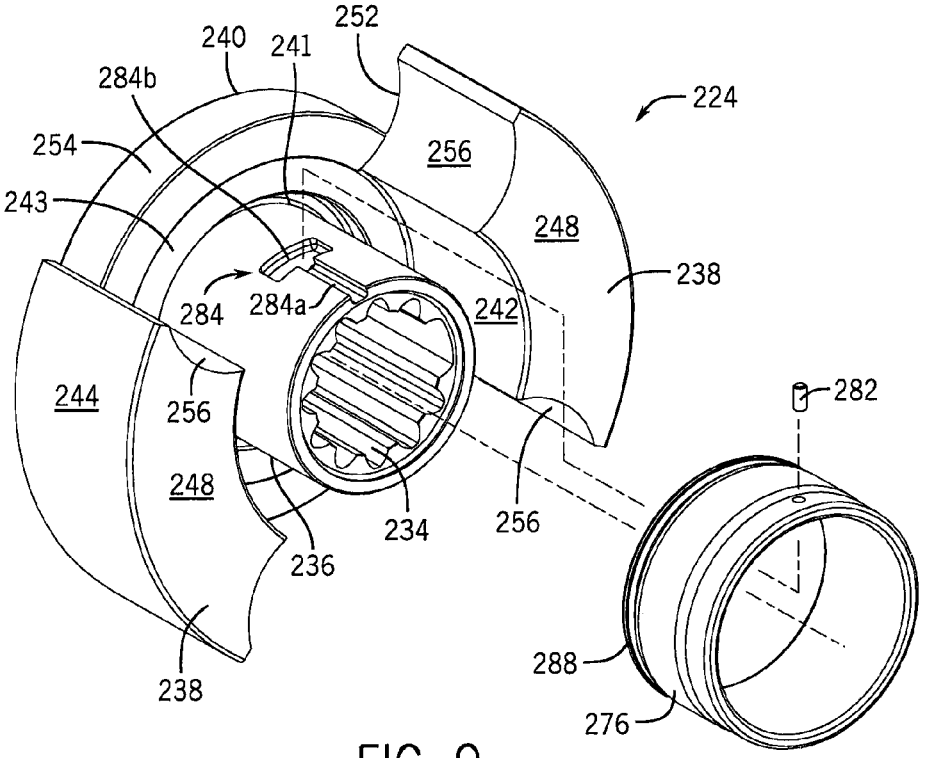
FIG. 9 is a detailed rear side perspective view of one of the rotors of the improved pump in which the forward sleeve is exploded from the rotor.
Figure 10:
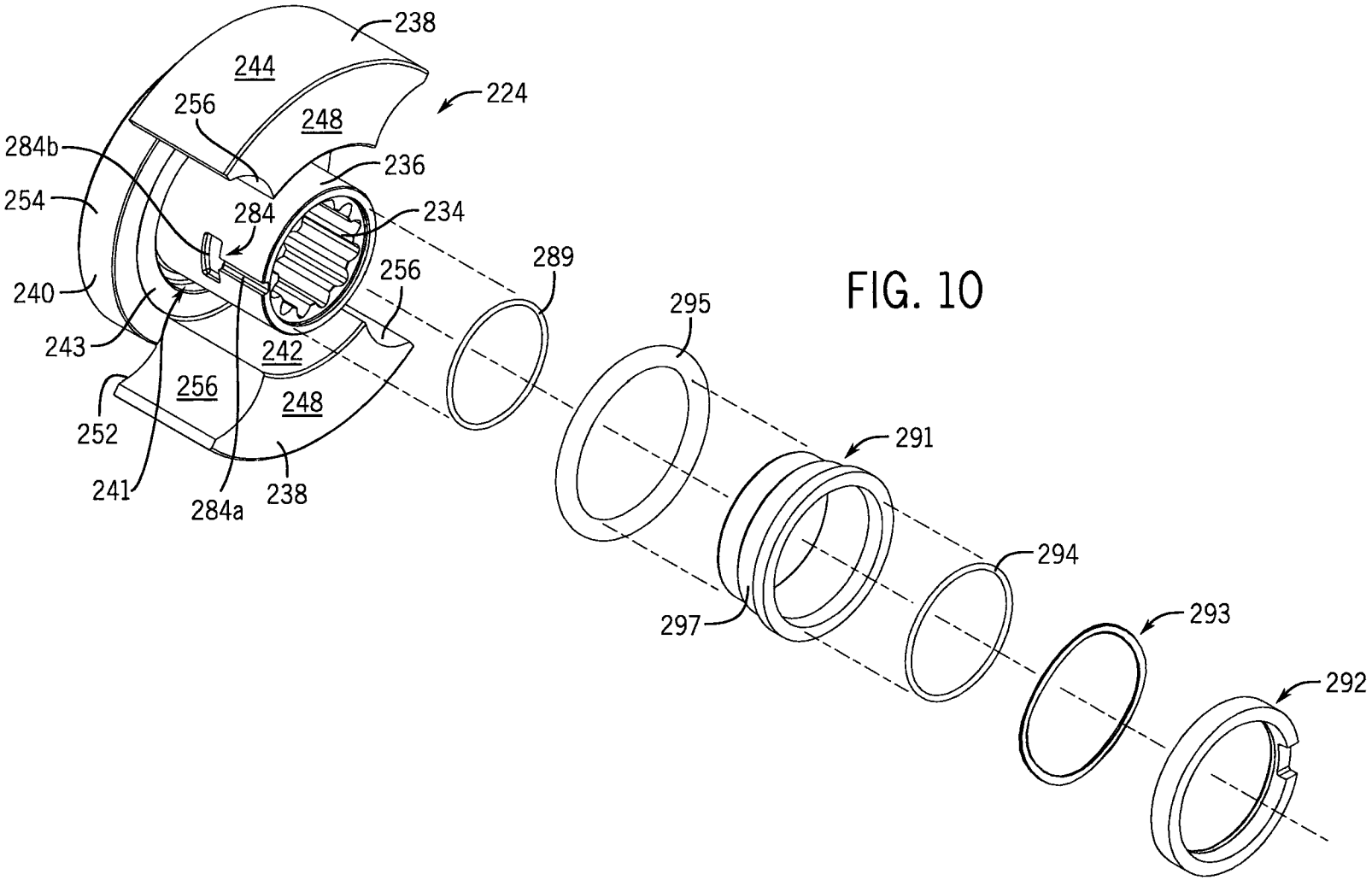
FIG. 10 is an exploded perspective view illustrating the rotor and the various parts of the rearwardly-positioned selective sealing arrangement outside of the improved pump.

As best seen in FIGS. 9 and 10, which shows the rear side of one of the rotors 224 (which is otherwise similar to rotors 124, except in the ways described below relating to the inclusion of a groove 241 and the recess 284), each rotor 124, 224 includes two wings 138, 238 that are disposed on the outside of the hub 126, 226 when the rotors 124, 224 are installed in the pump body 108, 208). That is to say, the wings 138, 238 are disposed radially outward of the radially outward facing surface 130, 230 of the hub 126, 226 when the pump 100, 200 is assembled. It will be appreciated that while two wings 138, 238 are illustrated on each rotor 124, 224, that variations on the type of rotor and the number of wings or lobes can be made. For example, in certain pumps, there may be only a single wing, two wings, or more than two wings.

In order to link the central portion 136, 236 of the rotors 124, 224 (which is disposed in the axially-extending opening 132, 232 of the hub 126, 226) to the wings 138, 238 (which are disposed on the outside of the hub 126, 226), the rotors 124, 224 include a disc-shaped portion 140, 240 on the forward axial end of each if the rotors 124, 224 that links the central portion 136, 236 to the wings 138, 238. In the form shown, this disc-shaped portion 140, 240 is integrally formed with both the central portion 136, 236 and the wings 138, 238 of the rotor 124, 224. When assembled, the disc-shaped portion 140, 240 of the rotor 124, 224 is forward of the front axial end of the hub 126, 226.

By having portions of the various surfaces of the wings 138, 238 of the rotor 124, 224 closely match the surfaces that they pass during rotation within the pump body 108, 208, the rotors 124, 224 can efficiently turn their rotation into a pumping force on the fluid being transported. Looking specifically at the rotor 224 in FIGS. 9 and 10, a radially inward facing surface 242 of the wings 238 is generally shaped so as to be closely positioned to the radially outward facing surface 230 of the hub 226 and a radially outward facing surface 244 of the wings 240 are generally shaped so as to be closely positioned to at least a portion of a side wall 246 defining a portion of the internal cavity 218 of the pump body 208 as best shown in FIG. 3. Additionally, a rear axial surface 248 of each of the wings 238 is closely positioned to a rear wall 250 of the internal cavity 218 (again, best shown in FIG. 3) and the front axial surfaces 252 of the wings 238 and a radially outward facing wall 254 of the disc-shaped portion 240 (again, best shown in FIG. 3) all can be closely positioned to the back side wall of the cover 216.

When both rotors 224 are attached, because the rotors 224 each include two wings 238, the rotors 224 are 90 degrees out of phase with one another on the output shafts 214. This permits the intermeshing of the wings 238 of the rotors 224 when the rotors 224 are spun in opposite directions about their respective axes of rotation. Both the angular ends 256 of the wings 238 and a portion of the hubs 126, 226 (for example, see FIG. 2, showing portions 158 of the hubs 126 which also have a similar exterior profile as the hubs 226) can have concave arcuate sections so as to provide clearance as the rotors 124, 224 rotate within the internal cavity 118, 218 of the pump body 108, 208.

In order to axially secure the rotor 124, 224 on the output shaft 114, 214, fastening elements 160, 260 engages both the rotor 124, 224 and the shaft 114, 214. In the particular form illustrated, on the end of the output shaft 114, 214 furthest from the gear case 106, 206, the output shaft 114, 214 has a threaded portion which extends out of the front side of the opening 134, 234 of the central portion 136, 236 of the rotor 124, 224 when the rotor 124, 224 is received on the shafts 114, 214.

With the structure of the pump 100 having been described, the general operation of the pump 100 will now be explained. In general operation, the inlet line 102 provides fluid to the pump 100 via an inlet 162 on one lateral side of the pump body 108. The rotors 124 are driven in opposing rotational direction (e.g., clockwise and counter-clockwise) by the output shafts 114 of the gear case 106 in order to pump the fluid received at the inlet 162 through the internal cavity 118 of the pump body 108 and out an outlet 164 on a lateral side of the pump body 108 opposite to the inlet 162. It will be appreciated that the inlet 162 and outlet 164 are relative terms, as the rotors 124 can be driven in the opposite direction to provide a pumping action in a reverse direction.

Figure 4:
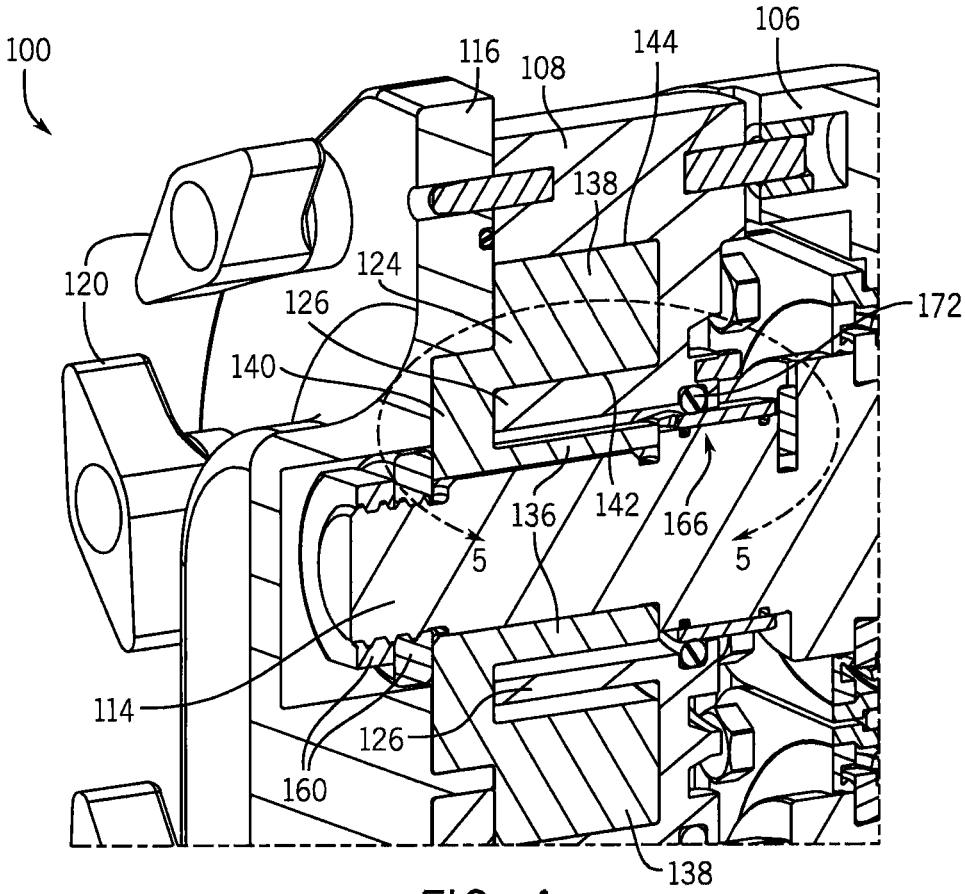
FIG. 4 PRIOR ART
FIG. 4 is a fragmentary cross-sectional view of the prior art pump of FIG. 2 taken through the midline of the pump in which the pump is in an assembled state.
Figure 5:
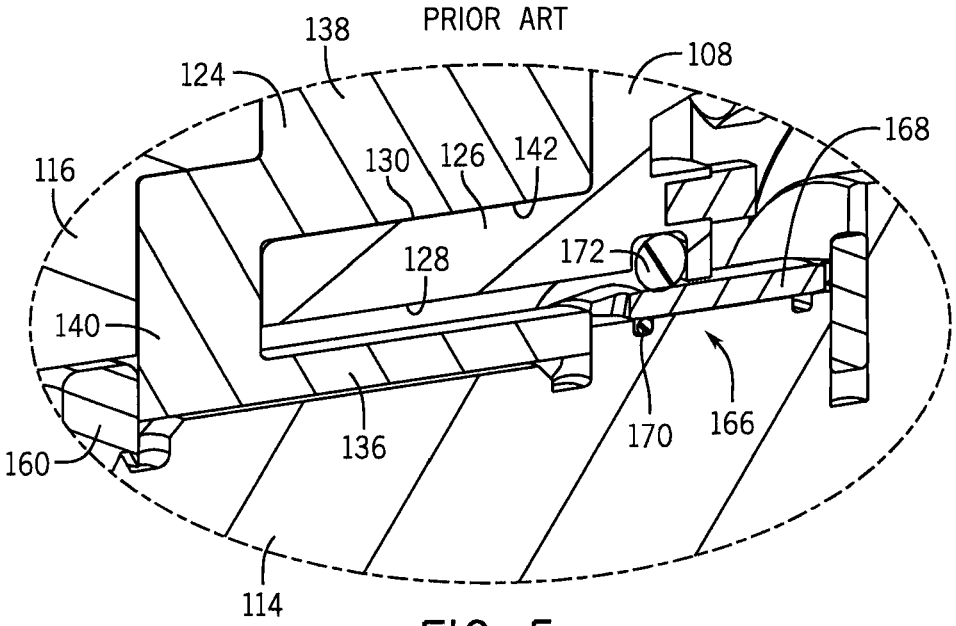
FIG. 5 PRIOR ART
FIG. 5 is a further detailed cross-sectional view of the sealing arrangement in line 5-5 of FIG. 4.

Notably, in order to prevent leakage between the pump body 108 and the gear case 106 in the prior art pump 100, there historically has been a sealing arrangement 166 disposed between portions of the gear case 106 (and, more specifically, the output shafts 114 of the gear case 106) and the pump body 108 as illustrated in FIGS. 4 and 5. Although only a single sealing arrangement 166 is illustrated and described, each of the output shafts 114 have a similar sealing arrangement at their base. In FIGS. 4 and 5, it can be seen that this sealing arrangement 166 includes a sleeve 168 received around the base of the output shaft 114, a static o-ring seal 170 received in an annular groove on the shaft 114 that establishes a static seal between the shaft 114 and the sleeve 168, and a dynamic o-ring seal 172 partially received in an annular groove in the pump body 108 that establishes a dynamic seal between the pump body 108 and the sleeve 168 when the shaft 114 rotates. This prior art sealing arrangement 166 both functioned to seal the interior cavity during normal operation of the prior art pump 100, as well as to seal the interior cavity 118 if the rotors 124 are removed prior to cleaning (in which a high velocity fluid was run through the internal cavity 118).

However, in order to access this prior art sealing arrangement 166 for service, maintenance, and the like, a large number of components would need to be disassembled including, most notably, the entirety of the pump body 108 from the gear case 106. FIG. 2 shows the parts that would need to be disassembled in order to access the prior art sealing arrangement 166. In anticipation of removing the pump body 108 from the gear case 106, the input line 102 and the output line 104 must be disconnected from the fluid inlet 162 and the fluid outlet 164, respectively, on the pump body 108. Further, in order to detach the pump body 108 from the gear case 106, a large section of the forward end of the pump 100 must be disassembled. To do this in the illustrated embodiment, the fastening handles 120 must first be unscrewed from the threaded posts 122 so that the cover 116 can be removed from the threaded posts 122 thereby revealing the interior cavity 118 of pump body 108. Then, fasteners 160 are unthreaded from the end of the output shafts 114. With the fasteners 160 removed, the rotors 124 can be removed from the internal cavity 118 of the pump body 108 by sliding the rotors 118 off of the output shafts 114 in an axial direction. Further, additional fastening bolts are unscrewed in order to disconnect the pump body 108 from the gear case 106. Only then could the pump body 108 be slid off of the threaded posts 122 so as to separate the pump body 108 from the gear case 106. It should be noted that the pump body 108 is made of metal and can be very heavy, particularly on large pumps. For very large pump sizes, the handling of the pump body 108 may require the assistance of mechanical lifting equipment.

Only with all these disassembly steps having been performed and with the pump body 108 having been removed, are each of the prior art sealing arrangements 166 near the base of the output shafts 114 accessible. Needless to say, FIG. 2 illustrates the large amount of disassembly that needs to be performed in order to access this sealing arrangement 126. All of these components would then need to be re-assembled in order to place the pump back in normal operation condition.

In stark comparison, FIG. 3 illustrates the parts to be disassembled for access to a forwardly-positioned sealing arrangement 274 in the improved pump 200. Like the prior art sealing arrangement 166, the forwardly-positioned sealing arrangement 274 serves to form a portion of the seal in the internal cavity 218 of the pump 200. However, unlike the prior art sealing arrangement 166 which is disposed between the base of the shaft 114 and the pump body 108, the forwardly-positioned sealing arrangement 274 is positioned proximate a forward end of the shaft 214 to form a seal between one of the shafts 214 and a rotor 224. This means, among other things, that it is not necessary to remove the pump body 208 from the gear case 206 in order to remove the forwardly-positioned sealing arrangement 274 from the improved pump 200.

The structure of the forwardly-positioned sealing arrangement 274 is now described in greater detail with reference to FIGS. 3, 6, 7, and 9. Again, although only one forwardly-positioned sealing arrangement 274 is illustrated, it should be appreciated that a forwardly-positioned sealing arrangement 274 is placed between each of the rotors 224 and a corresponding hub 226 of the pump body 208. The forwardly-positioned sealing arrangement 274 includes a forward sleeve 276, a static o-ring seal 278, and a dynamic o-ring seal 280.

The forward sleeve 276 has a generally cylindrically tubular shaped body. The forward sleeve 276 has a projection 282 that extends radially inward from a radially inward facing surface of the forward sleeve 276. This projection 282 could be formed in a number of ways, but it is contemplated that, at least in some forms, the projection 282 could be press fit into an opening formed in the generally cylindrically tubular shaped body.

As is best illustrated in FIG. 9, the forward sleeve 276 is received around the central portion 236 of the rotor 224. On a radially outward facing surface of the central portion 236 of the rotor 224, a recess 284 is formed. This recess 284 includes a narrow section 284*a* extending from an axial end of the central portion 236 of the rotor 224 to a wide section 284*b* at the other end of the narrow section 284*a*. The wide section 284*b* has a larger angular extent than the narrow section 284*a*.

When the forward sleeve 276 is received around the central portion 236 of the rotor 224, the projection 282 is received in the recess 284 in order to rotationally couple the forward sleeve 276 to the rotor 224. During assembly as the forward sleeve 276 is inserted onto the central portion 236 of the rotor 224, the projection 282 is first received in the narrow section 284*a* of the recess 284 and, as the forward sleeve 276 is pushed further forward onto the central portion 236 of the rotor 224, the projection 282 is ultimately received in the wide section 284*b*. When the forward sleeve 276 is rotated relative to the rotor 224, the projection 282 and the recess 284 couple the rotation of the forward sleeve 276 to the rotor 224 (at least to some degree, given that the wide section 284*b* has an angular extent). Moreover, upon the rotation of the central portion 236 of the rotor 224, the projection 282 will move into a portion of the wide section 284*b* of the recess 284 that is not aligned with the narrow section 284*a*, thereby preventing the forward sleeve 276 from substantially axially moving rearward on the rotor 224 (and potentially compromising the seals).

Figure 6:
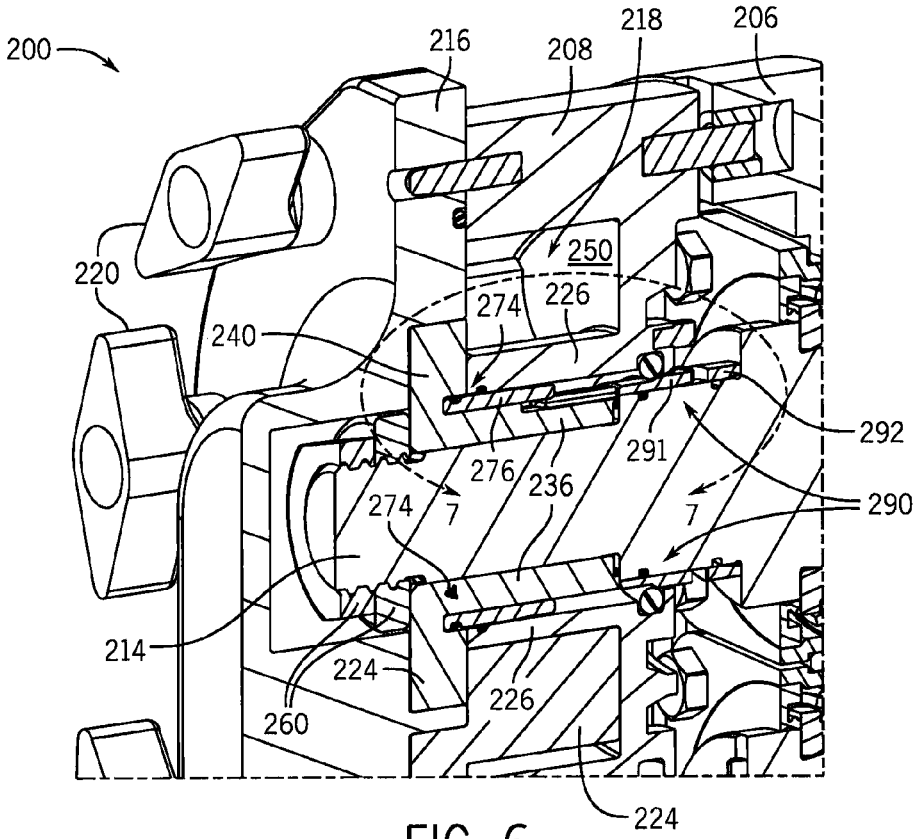
FIG. 6 is a fragmentary cross-sectional view of the improved pump of FIG. 3 taken through the midline of the improved pump in which the improved pump is in an assembled state.
Figure 7:
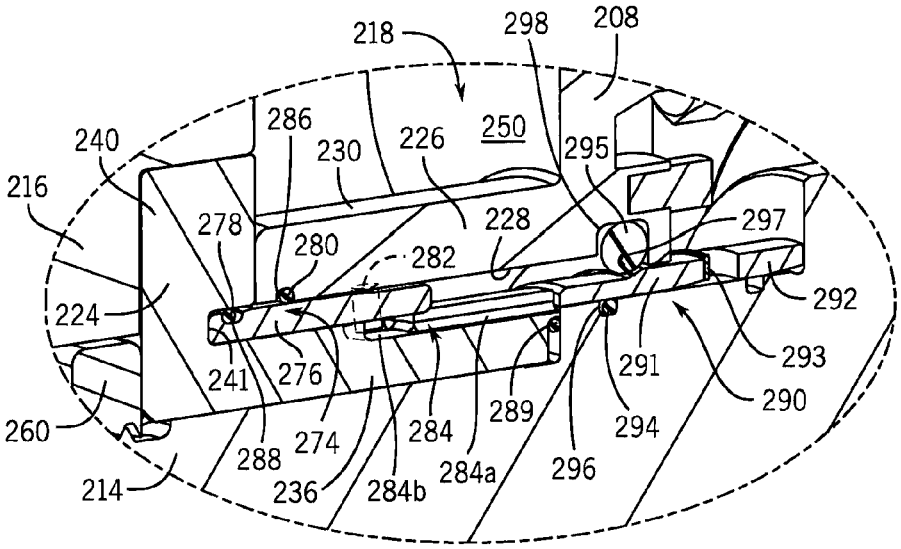
FIG. 7 is a detailed cross-sectional view of a forwardly-positioned sealing arrangement and a rearwardly-positioned selective sealing arrangement in line 7-7 of FIG. 6. In this view, the rearwardly-positioned selective sealing arrangement is in the non-sealing position.

When the rotor 224 is received on the output shaft 214, then the forward sleeve 276 is positioned between the central portion 236 of the rotor 224 and a forward end of the hub 226. In this position, static o-ring seal 278 establishes a static seal between the forward sleeve 276 and the rotor 224 and the dynamic o-ring seal 280 establishes the dynamic seal between the forward sleeve 276 and the hub 226. These seals are best illustrated in FIGS. 6 and 7.

In the illustrated embodiment, in order to form the dynamic seal, an annular channel 286 is formed in a radially inwardly facing surface of the hub 226 and the dynamic o-ring seal 280 is received, at least in part, in the annular channel 286. The dynamic seal is established between the radially inward facing surface of the hub 226 and a radially outward facing surface of the forward sleeve 276, which the dynamic o-ring seal 280 also contacts.

With respect to the static seal, as mentioned above, the rotor 224 includes a disc-shaped portion 240 connecting the wings 238 to the central portion 236 of the rotor 224 at a forward end of the rotor 224. In the illustrated embodiment, and as best illustrated in FIG. 9, a groove 241 is formed in a rearwardly facing axial surface 243 of the disc-shaped portion 240 between the central portion 236 and the wings 238. A forward end of the forward sleeve 276 is received into this groove 241.

In order to form the static seal, the static o-ring seal 278 is received, at least in part, in an annular channel 288 formed in the radially outward facing surface of the forward sleeve 276 that resides in the groove 241. The static o-ring seal 278 is received in the annular channel 288 between a radially outward facing surface of the forward sleeve 276 and a radially inward facing surface of the rotor 224 to form a static seal between the forward sleeve 276 and the rotor 224 within the space of the groove 241.

Additionally, as best seen in FIGS. 7 and 10, an o-ring 289 is received in a groove formed on a rearwardly-facing axial end of the central portion 236 of the rotor 224. This o-ring 289 forms a seal between a forwardly-facing axial surface of the shaft 214 and a surface on the rearward axial end of the rotor 224. This o-ring 289 forms a static seal, albeit a static seal that rotates with the rotor 224 and the output shaft 214 since they rotate together during pumping. The static seal formed by this o-ring 289 prevents any fluid that is being pumped that has migrated through the small volume between splines of the rotor 224 and the shaft 214 from leaking out of the rear side of the pump body 208.

Returning now to FIGS. 2 and 3, the amount of disassembly required to access either the prior art sealing arrangement 166 or the forwardly-positioned sealing arrangement 274 is comparatively illustrated. In view of the description above, it can be seen from FIG. 3 that in order to access the forwardly-positioned sealing arrangement 274, very few parts need to be removed. First, the cover 216 is opened after removing the fastening handles 220 from the threaded posts 222. Then, the fastening elements 260 are removed from the output shafts 214, so that the rotors 224 can be removed from the shafts 214. At this point, the elements of the forwardly-positioned sealing arrangement 274 are readily accessible for servicing.

Again, notably, the pump body 208 does not need to be removed from the gear case 206 in order to access the forwardly-positioned sealing arrangement 274. It should be stressed that this sealing arrangement 166 between the pump body 108 and the gear case 106 requires the pump body 108 to be separated from the gear case 106 in order to service the sealing arrangement 166. Unfortunately, this can mean that when inlet and outlet lines 102, 104 are connected to the pump body 108, that these lines 102, 104 will typically need to be disconnected prior to removal of the pump body 108, which is both time-consuming and prone to raise complications with the assembly. The re-assembly of the pump 100 and the reconnection of the inlet and outlet lines 102, 104 to the pump body 108 introduces the possibility that a bad connection may be made (i.e., an area in which a seal is formed may not be properly reestablished) or that, over time, the connections may fatigue and begin to leak. The new pump 200 is less prone to such issues.

One notable issue with replacing the old sealing arrangement 166 with the forwardly-positioned sealing arrangement 274 is that the old sealing arrangement 166 also performed the function of sealing the inner cavity 118 when the rotors of the pump 100 were removed for cleaning by running high velocity fluid through the inner cavity 118. With the removal of the rotors 224 for fluid cleaning, the forwardly-positioned sealing arrangement 274 are also removed.

To overcome this problem with the removal of the forwardly-positioned sealing arrangement 274, a pair of rearwardly-positioned selective sealing arrangements 290 are introduced to form selective seals between the pump body 208 and the gear case 206 (and, more specifically, the base of the shafts 214 in the form illustrated) depending on whether or not the rotors 224 are secured on the shafts 214.

Figure 8:
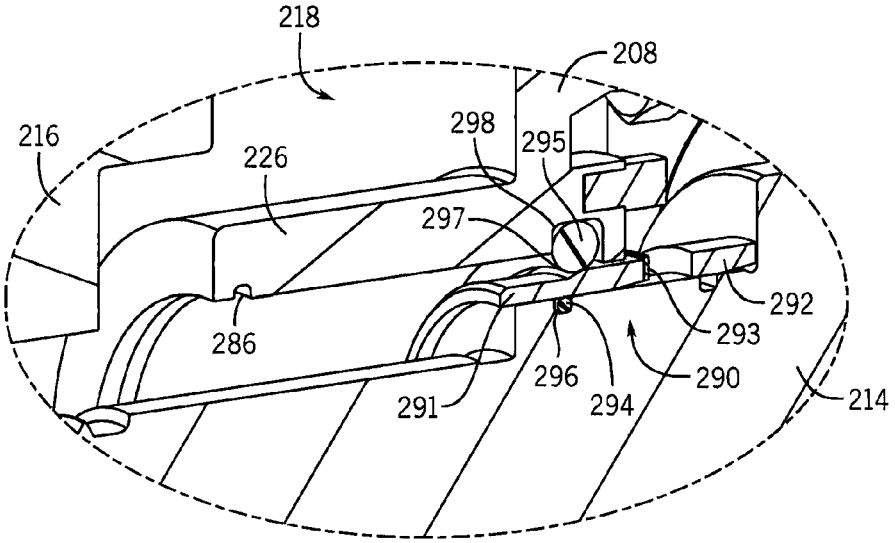
FIG. 8 is a detailed cross-sectional view similar to that shown in FIG. 7, but in which the rotor has been removed such that the rearwardly-positioned selective sealing arrangement is biased toward the sealing position.

In the form illustrated, the pair of rearwardly-positioned selective sealing arrangements 290 each include a slidable sleeve 291, a stationary sleeve 292, a biasing mechanism in the form of a wave spring 293, and at least two o-rings 294 and 295. As best illustrated in FIGS. 6, 7, and 8, the rearwardly-positioned selective sealing arrangement 290 is positioned proximate the base of the shaft 214 such that the slidable sleeve 291 is positioned between the shaft 214 and the pump body 208. In the form illustrated, there are two sleeve sections (the slidable sleeve 291 and the stationary sleeve 292) with a biasing mechanism or wave spring 293 disposed between them to bias the sleeve sections away from one another. Because the stationary sleeve 292 contacts an axial base wall of the shaft 214 and is fixed in place when the pump 200 is assembled, this means that the biasing member causes the slidable sleeve 291 to be biased forwardly (that is, toward the left side of FIGS. 7 and 8). However, it is contemplated that in some embodiments, the stationary sleeve 292 could be omitted altogether and the biasing member may directly contact the base of the shaft (or some other intermediate object) to apply the biasing force to the slidable sleeve 291. Similarly, although the biasing member is shown in the form of a wave spring, it is contemplated that other types of springs or biasing members could also be used.

In order to form selective seals, the o-rings 294 and 295 are positioned on opposing radial sides of the slidable sleeve 291. One of the o-rings 294 is placed in an annular groove 296 formed in a radially outward facing surface of the shaft 214. This o-ring 294 forms a seal between the radially outward facing surface of the shaft 214 and the radially inward facing surface of the slidable sleeve 291. Another one of the o-rings 295 is positioned between the pump body 208 and a sealing surface 297 (which is angled, oblique, or otherwise not parallel with the direction of movement of the slidable sleeve 291 for reasons that will be discussed below) which is disposed on the radially outward facing side of the slidable sleeve 291. The o-ring 295 is received with some potential amount of play in an annular groove 298 in the pump body 208 at the rearward end of the pump body 208 and respective hub 226.

The slidable sleeve 291 is movable between a non-sealing position as illustrated in FIG. 7 and a sealing position as illustrated in FIG. 8. In the form illustrated, the slidable sleeve 291 moves linearly between the sealing position and the non-sealing position along a direction of movement parallel to the axis of the shaft 214.

Whether a selective seal is formed by the rearwardly-positioned selective sealing arrangement 290 depends on whether or not a rotor 224 is received on the output shaft 214. This condition establishes the spacing between the sealing surface 297 of the slidable sleeve 291 and the pump body 208 which determines if the o-ring 295 is compressed therebetween to form a seal.

As illustrated in FIG. 7, when a rotor 224 is secured on the output shaft 214, the rearwardly facing axial end of the central portion 236 of the rotor 224 engages the forwardly facing axial end of the slidable sleeve 291. This engagement of the rotor 224 and the slidable sleeve 291 causes a physical displacement of the slidable sleeve 291 against the biasing force of the biasing mechanism (in the form show, the wave spring 293) to the non-sealing position illustrated in FIG. 7. In this non-sealing position, the o-ring 295 is not compressed between the sealing surface 297 of the slidable sleeve 291 and the pump body 208.

As illustrated in FIG. 8, when the rotor 224 is removed from the output shaft 214, the rearwardly facing axial end of the central portion 236 of the rotor 224 does not engage the forwardly facing axial end of the slidable sleeve 291. This lack of engagement of the rotor 224 and the slidable sleeve 291 permits the slidable sleeve 291 to move forward due to the biasing force applied by the biasing mechanism to the sealing position illustrated in FIG. 8. In this sealing position, the o-ring 295 is compressed between the sealing surface 297 of the slidable sleeve 291 and the pump body 208 by the compressive force of the biasing mechanism.

In sum, the biasing mechanism biases the slidable sleeve 291 toward the sealing position and, only when the rotor 224 is secured to the shaft 214, does an axial end of the rotor 224 engage an axial end of the slidable sleeve 291 to move the slidable sleeve to the non-sealing position. Otherwise, when the rotors 224 are removed from the shafts 214, the rearwardly-positioned selective sealing arrangements 290 form seals between the shafts 214 of the gear case 206 and the pump body 208.

Accordingly, the pair of rearwardly-positioned selective sealing arrangements 290 help to selectively seal the internal cavity 218 when the rotors 224 and the forwardly-positioned sealing arrangements 274 have been removed for high velocity fluid cleaning. However, when the rotors 224 and the forwardly-positioned sealing arrangements 274 are attached during normal operation, the rearwardly-positioned selective sealing arrangements 290 do not establish complete seals between the shafts 214 and the pump body 208. Further, because the rearwardly-positioned selective sealing arrangements 290 are disposed in an area of the pump 200 in which the product being pumped during normal operation is not received, the sanitation and chemical requirements of these rearwardly-positioned selective sealing arrangements 290 are of less concern.

It should be appreciated that while one angled sealing surface is illustrated on a radially outward facing side of the stationary sleeve in the illustrated embodiment, that variations on this arrangement are contemplated. For example, it is possible that there could be more than one sealing surface that is angled or otherwise shaped to form the selective seal and that these multiple surfaces could be on one or both sides of the sliding sleeve. Accordingly, it is contemplated that more than one selective seal may be formed.

Thus, an improved pump is provided in which a primary sealing arrangement that is formed during normal pumping operation of the pump is removable without removing the pump body from the gear case. Additionally, a supplemental or secondary rearward selective sealing arrangement is provided that can be used to seal the internal cavity of the pump when the rotors and other sealing arrangement are removed for cleaning.

Moreover, it is contemplated that existing prior art pumps of the style described above with respect to FIGS. 1, 2, 4, and 5, could be readily modified to incorporate the improved sealing structures. By machining annular channels for reception of the o-rings in the hub, modifying the rotors to accommodate the forwardly-positioned sealing arrangement, and by introducing the rearwardly-positioned selective sealing arrangements, existing pumps may be readily retrofit to this improved pump style.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A rotary positive displacement pump for pumping a fluid, the rotary positive displacement pump comprising:

a gear case including a pair of shafts extending therefrom at a forward end;

a pump body supported by the gear case on the forward end of the gear case, the pump body having a cover attached thereto so as to define a cavity between the pump body and the cover in which the cavity has an inlet and an outlet, the pump body having a pair of hubs that extend into the cavity in which each of the pair of hubs has an axially-extending opening through each one of which a corresponding one of the pair of shafts from the gear case is received;

a pair of rotors, each of the pair of rotors having a central portion received on one of the pair of shafts inside the axially-extending opening of the hub, each rotor having wings attached to the central portion of the rotor in which the wings of the rotor are disposed radially outward of the hub when the central portion of the rotor is attached to the shaft, the rotors on the pair of shafts being rotatable in opposite directions to pump a fluid through the pump body from the inlet through the cavity to the outlet;

a pair of forwardly-positioned sealing arrangements each forming a dynamic seal between the central portion of the one of the pair of rotors and a corresponding one of the pair of hubs proximate a forward end of the pair of shafts; and a pair of rearwardly-positioned selective sealing arrangements between the gear case and the pump body proximate a rearward end of the pair of shafts wherein, when the pair of rotors are secured to the pair of shafts, the pair of rearwardly-positioned selective sealing arrangements do not establish seals between the gear case and the pump body and wherein, when the pair of rotors are removed from the pair of shafts, the pair of rearwardly-positioned selective sealing arrangements establish seals between the gear case and the pump body.

2. The rotary positive displacement pump of claim 1, wherein the pair of rotors and the pair of forwardly-positioned sealing arrangements are removable from the rotary positive displacement pump without removing the pump body from the gear case.

3. The rotary positive displacement pump of claim 1, wherein each of the pair of forwardly-positioned sealing arrangements includes a forward sleeve, a static o-ring seal, and a dynamic o-ring seal, in which the forward sleeve is received around the central portion of the rotor and is positioned between the central portion of the rotor and one of the pair of hubs of the pump body and wherein the static o-ring seal establishes a static seal between the forward sleeve and the rotor and the dynamic o-ring seal establishes the dynamic seal between the forward sleeve and the hub.

4. The rotary positive displacement pump of claim 3, wherein the forward sleeve and the rotor are rotationally coupled to one another.

5. The rotary positive displacement pump of claim 4, wherein the forward sleeve includes a projection that extends radially inward and the rotor includes a recess on a radially outward facing surface of the central portion of the rotor and wherein the projection is received in the recess when the forward sleeve is received around the central portion of the rotor in order to rotationally couple the forward sleeve to the rotor.

6. The rotary positive displacement pump of claim 5, wherein the recess includes a narrow section extending from an axial end of the central portion of the rotor to a wide section of the recess at the other end of the narrow section, the wide section having a larger angular extent than the narrow section.

7. The rotary positive displacement pump of claim 3, wherein an annular channel is formed on a radially inwardly facing surface of the hub and wherein the dynamic o-ring seal is received, at least in part, in the annular channel and the dynamic seal is established between the radially inward facing surface of the hub and a radially outward facing surface of the forward sleeve.

8. The rotary positive displacement pump of claim 3, wherein the static o-ring seal is received between a radially outward facing surface of the forward sleeve and a radially inward facing surface of the rotor.

9. The rotary positive displacement pump of claim 8, wherein the static o-ring seal is received, at least in part, in an annular channel in the radially outward facing surface of the forward sleeve.

10. The rotary positive displacement pump of claim 3, wherein the rotor includes a disc-shaped portion connecting the wings to the central portion of the rotor at a forward end of the rotor.

11. The rotary positive displacement pump of claim 10, wherein a groove is formed in a rearwardly facing axial surface of the disc-shaped portion between the central portion and the wings.

12. The rotary positive displacement pump of claim 11, wherein a forward end of the forward sleeve is received into the groove and the static o-ring seal is disposed between the forward sleeve and a radial wall of the groove.

13. The rotary positive displacement pump of claim 1, wherein the pair of rearwardly-positioned selective sealing arrangements each include a slidable sleeve, a biasing mechanism, and at least two o-rings.

14. The rotary positive displacement pump of claim 13, wherein the slidable sleeve is movable between a non-sealing position in which at least one of the at least two o-rings does not establish a seal and a sealing position in which at least one of the at least two o-rings establishes a seal between the slidable sleeve and the pump body and in which at least one of the at least two o-rings establishes a seal between the slidable sleeve and the shaft.

15. The rotary positive displacement pump of claim 14, wherein the slidable sleeve moves linearly between the sealing position and the non-sealing position along a direction of movement and wherein the slidable sleeve includes a sealing surface not parallel with the direction of movement which, in the sealing position, establishes a portion the seal with at least one of the at least two o-rings.

16. The rotary positive displacement pump of claim 14, wherein the biasing mechanism biases the slidable sleeve toward the sealing position and, when the rotor is secured to the shaft, an axial end of the rotor engages an axial end of the slidable sleeve to move the slidable sleeve to the non-sealing position.

17. The rotary positive displacement pump of claim 13, wherein the slidable sleeve includes two parts separated by the biasing mechanism.

18. The rotary positive displacement pump of claim 13, wherein the biasing mechanism is a spring.

19. The rotary positive displacement pump of claim 1, wherein, when the pair of rotors are removed from the pair of shafts, the pair of rearwardly-positioned selective sealing arrangements form seals between the pair of shafts of the gear case and the pump body.

* * * * *